US008313310B2

(12) United States Patent
Uchikado

(10) Patent No.: US 8,313,310 B2
(45) Date of Patent: Nov. 20, 2012

(54) VARIABLE DISPLACEMENT SWASH PLATE COMPRESSOR

(75) Inventor: Iwao Uchikado, Isesaki (JP)

(73) Assignee: Sanden Corporation, Gunma (JP)

( * ) Notice: Subject to any disclaimer, the term of this patent is extended or adjusted under 35 U.S.C. 154(b) by 429 days.

(21) Appl. No.: 12/516,731

(22) PCT Filed: Nov. 30, 2007

(86) PCT No.: PCT/JP2007/073168

§ 371 (c)(1),
(2), (4) Date: May 28, 2009

(87) PCT Pub. No.: WO2008/066155

PCT Pub. Date: Jun. 5, 2008

(65) Prior Publication Data

US 2010/0068075 A1 Mar. 18, 2010

(30) Foreign Application Priority Data

Dec. 1, 2006 (JP) ..... 2006-325542

(51) Int. Cl.
*F04B 1/12* (2006.01)

(52) U.S. Cl. ..... 417/269

(58) Field of Classification Search ..... 417/269
See application file for complete search history.

(56) References Cited

FOREIGN PATENT DOCUMENTS

| | | | |
|---|---|---|---|
| DE | 42 11 695 | | 10/1992 |
| JP | 5-52273 | | 7/1993 |
| JP | 52273/1993 | | 7/1993 |
| JP | 3025244 | | 3/1996 |
| JP | 3-025244 | | 6/1996 |
| JP | 3025244 | | 6/1996 |
| JP | 2000-283025 | | 10/2000 |
| JP | 2000283025 | A * | 10/2000 |
| JP | 2004-293388 | | 10/2004 |
| JP | 2005-113907 | | 4/2005 |

* cited by examiner

*Primary Examiner* — Anh Mai
*Assistant Examiner* — Brenitra Lee
(74) *Attorney, Agent, or Firm* — Cozen O'Connor

(57) ABSTRACT

A variable displacement swash plate compressor includes a swash-plate boss (50) permitting a rotary shaft to extend therethrough and coupled to the rotary shaft so as to be tiltable relative to the rotary shaft, the swash-plate boss having a thread groove (78) cut in an outer peripheral surface thereof, an annular swash plate (60) fitted around the swash-plate boss (50), a nut (64) screwed on the thread groove (78) of the swash-plate boss (50) to fix the swash plate (60) to the swash-plate boss (50), a conversion device for converting rotating motion of the swash plate (60) to reciprocating motion of pistons, and engaging protuberances (68) formed integrally with the nut (64) and protruding in a direction parallel with the axis (A) of the nut (64) to be engaged with a tool (80) for turning the nut (64).

4 Claims, 11 Drawing Sheets

VARIABLE DISPLACEMENT SWASH PLATE COMPRESSOR

RELATED APPLICATIONS

This is a U.S. National Phase Application under 35 USC §371 of International Application PCT/JP2007/073168 filed on Nov. 30, 2007.

This application claims the priority of Japanese Patent Application No. 2006-325542 filed Dec. 1, 2006, the entire content of which is hereby incorporated by reference.

TECHNICAL FIELD

The present invention relates to variable displacement swash plate compressors, and more particularly, to a variable displacement swash plate compressor suitable for use as a compressor of a refrigeration circuit using $CO_2$ as a refrigerant.

BACKGROUND ART

In a variable displacement swash plate compressor used as a compressor of, for example, a refrigeration circuit, the rotating motion of a swash plate is converted to reciprocating motion of pistons in such a manner that the stroke length of the pistons is variable, as disclosed in Unexamined Japanese Patent Publication No. 2000-283025.

In the compressor disclosed in this publication, the swash plate is fixed to a journal by means of a nut fitted around the boss of the journal (swash-plate boss) and screwed on a thread groove cut in the swash-plate boss.

DISCLOSURE OF THE INVENTION

In refrigeration circuits using $CO_2$ as their refrigerant, the density of the refrigerant is high, compared with the case of using R134a, and thus the compressor used in such refrigeration circuits may have a smaller suction capacity. A $CO_2$ refrigerant compressor with a suction capacity of 20 to 24 cc, for example, provides performance equivalent to that of an R134a refrigerant compressor having a suction capacity of 160 to 180 cc. Consequently, $CO_2$ refrigerant compressors tend to be reduced in size.

On the other hand, the working pressure of the $CO_2$ refrigerant circulated through the refrigeration circuit is approximately seven to ten times as high as that of the R134a refrigerant. Accordingly, internal components of the compressor that receive compressive load, such as the pistons and the swash plate, are required to have sufficiently high mechanical strength and cannot be reduced in size, unlike the overall size of the compressor.

Thus, in the case of $CO_2$ refrigerant compressors, the overall size tends to be reduced whereas the sizes of the internal components are almost the same as those of conventional ones, making the layout design difficult.

Specifically, in $CO_2$ refrigerant compressors, the pitch circle diameter, or PCD $\phi$, of cylinder bores is set to about 55 to 65 mm, and thus the nut for fixing the swash plate to the swash-plate boss should desirably be as small in size as possible. In the case of the compressor disclosed in the above publication, however, if the size of the nut is reduced and if engagement holes are formed through the nut for engagement with a nut tightening tool, the nut fails to provide satisfactory strength at portions thereof close the engagement holes.

The present invention was created in view of the above circumstances, and an object thereof is to provide a variable displacement swash plate compressor in which a swash plate is fixed to a swash-plate boss by means of a nut having high mechanical strength yet capable of leaving a sufficient clearance relative to pistons and which can be manufactured at low cost.

To achieve the object, the present invention provides a variable displacement swash plate compressor comprising: a swash-plate boss permitting a rotary shaft to extend therethrough and coupled to the rotary shaft in such a manner that the swash-plate boss is tiltable relative to the rotary shaft, the swash-plate boss having a thread groove cut in an outer peripheral surface thereof; an annular swash plate fitted around the swash-plate boss; a nut screwed on the thread groove of the swash-plate boss to fix the swash plate to the swash-plate boss; a conversion device for converting rotating motion of the swash plate to reciprocating motion of pistons; and engaging protuberances formed integrally with the nut and protruding in a direction parallel with an axis of the nut to be engaged with a tool for turning the nut.

In the variable displacement swash plate compressor of the present invention, the engaging protuberances for engaging with the tool protrude in the axial direction of the nut; therefore, the mechanical strength of the nut is ensured and also a sufficient clearance can be provided between the nut, or the engaging protuberances, and the pistons. Accordingly, the compressor provides high reliability even if reduced in size.

The engaging protuberances integral with the nut can be formed with ease by using a former or the like. Accordingly, the nut can be manufactured at high productivity, making it possible to provide the compressor at low cost.

Preferably, the engaging protuberances protrude from an end face of the nut located opposite the swash plate. Since the engaging protuberances protrude from the end face of the nut situated opposite the swash plate, it is easy to engage the tool with the engaging protuberances, whereby the nut can be easily screwed on the swash-plate boss.

Also, preferably, out of an outer peripheral surface of the nut and outer surfaces of the engaging protuberances as viewed in a radial direction of the nut, at least part of the outer surface of each engaging protuberance has at least one of a tapered region and a flat region as an inclined surface which is so inclined as to approach the axis of the nut with distance from the nut, and the inclined surface has an inclination angle nearly equal to that formed between the rotary shaft and an axis of the swash-plate boss when the swash-plate boss is tilted at a maximum angle relative to the rotary shaft.

With the preferred arrangement, the inclination angle of the inclined surface is nearly equal to that formed between the rotary shaft and the axis of the swash-plate boss when the swash-plate boss is tilted at the maximum angle relative to the rotary shaft, that is, when the displacement of the compressor is at a maximum. Consequently, a sufficient clearance is always left between the engaging protuberances and the pistons even while the swash-plate boss is tilted.

Preferably, the engaging protuberances are located inward of an imaginary tapered surface which is so defined as to avoid contact of the engaging protuberances with the pistons, and the imaginary tapered surface has an inclination angle nearly equal to that formed between the rotary shaft and the axis of the swash-plate boss when the swash-plate boss is tilted at the maximum angle relative to the rotary shaft.

With this arrangement, the engaging protuberances are located inward of the imaginary tapered surface which is so defined as to avoid contact of the engaging protuberances with the pistons, and thus even when the swash-plate boss is tilted, a sufficient clearance is left between the engaging protuberances and the pistons.

BEST MODE OF CARRYING OUT THE INVENTION

Figure 1:
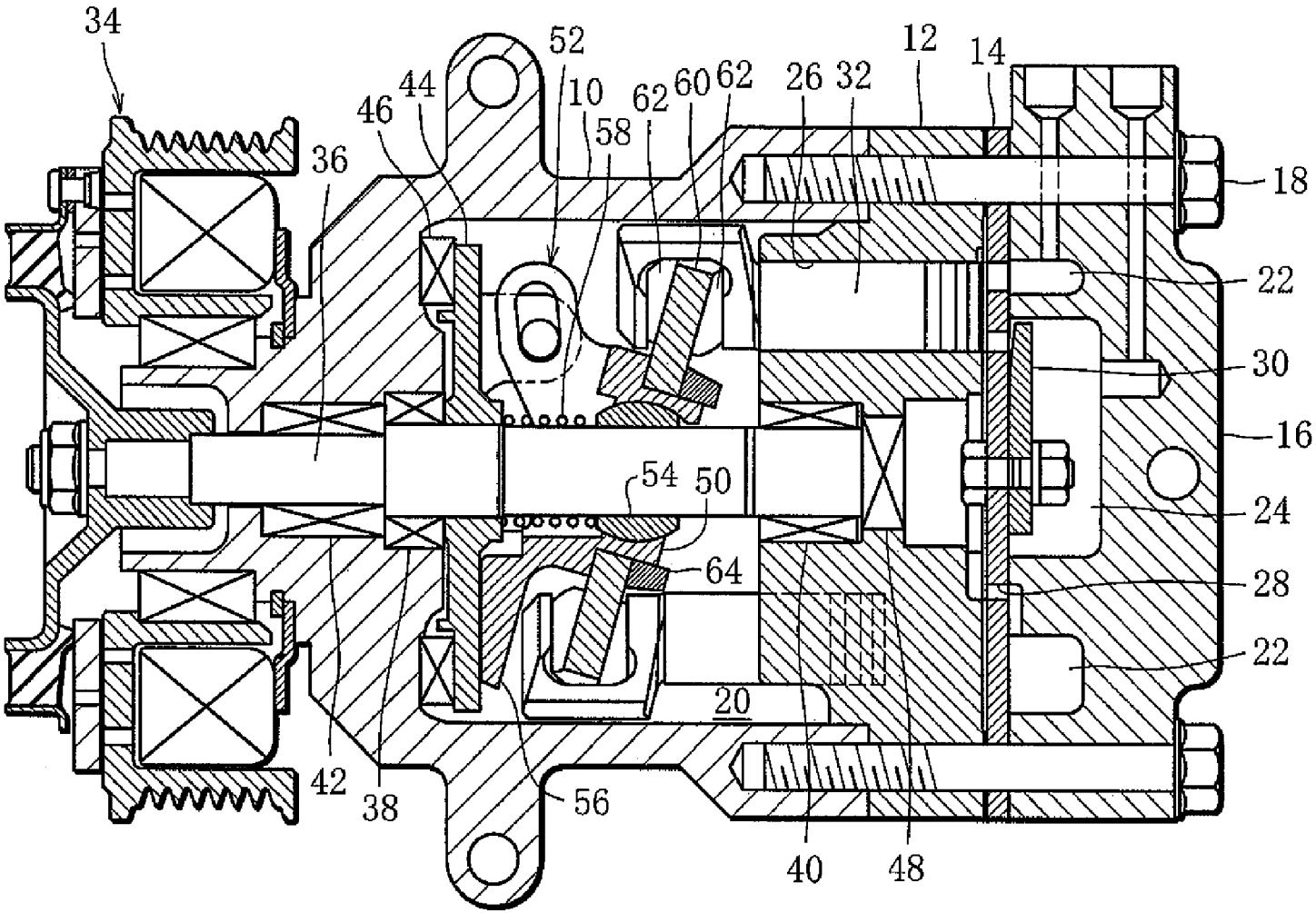
FIG. 1 is a longitudinal sectional view of a variable displacement swash plate compressor according to a first embodiment.

FIG. 1 shows a variable displacement swash plate compressor according to a first embodiment.

The compressor has a casing (front housing) 10 forming part of a housing thereof. A cylinder block 12, a valve plate 14 and a cylinder head 16 are airtightly secured, in the order mentioned, to one end of the casing 10 by a plurality of bolts 18. A crank chamber 20 is defined between the other end of the casing 10 and the cylinder block 12.

The cylinder head 16 is provided with a suction port and a discharge port, and has suction and discharge chambers 22 and 24 formed therein in communication with the suction and discharge ports, respectively. The suction chamber 22 can communicate with each cylinder bore 26 in the cylinder block 12 through a suction reed valve (not shown) and always communicates with the crank chamber 20 through a fixed orifice 28 formed through the valve plate 14.

The discharge chamber 24 can communicate with each cylinder bore 26 through a discharge reed valve comprising a reed valve element (not shown) and a valve stopper 30. Also, the discharge chamber 24 is connected to the crank chamber 20 through a communication passage, though not shown, and a solenoid valve is disposed in the communication passage. The solenoid valve is externally controlled to open and close the communication passage, for example, to thereby intermittently establish communication between the discharge chamber 24 and the crank chamber 20.

A piston 32 is inserted into each cylinder bore 26 of the cylinder block 12 from the crank chamber side, for reciprocating motion in the corresponding cylinder bore 26. Each piston 32 has a tail projecting into the crank chamber 20. Motive power from a driving power source, such as an automotive engine, is intermittently transmitted to the tails of the pistons 32. To this end, the compressor has an electromagnetic clutch 34 to be input with the motive power.

Specifically, the electromagnetic clutch 34 includes a driving unit rotatably attached to the other end of the casing 10, and a driven unit securely fixed to an outer end of a rotary shaft 36 penetrating through the other end of the casing 10.

The rotary shaft 36 extends through the crank chamber 20 up to the cylinder block 12 and is rotatably supported by the casing 10 and the cylinder block 12 with two radial bearings 38 and 40 therebetween. A lip seal 42 is fitted around the rotary shaft 36 at a location closer to the electromagnetic clutch 34 than the radial bearing 38 and seals the crank chamber 20 in an airtight fashion.

The compressor is also provided with a conversion mechanism for converting the rotating motion of the rotary shaft 36 to reciprocating motion of the pistons 32 over a variable stroke length.

More specifically, a disc-shaped rotor 44 is fixed on the rotary shaft 36, and a thrust bearing 46 is arranged between the rotor 44 and the other end of the casing 10. An inner end of the rotary shaft 36 close to the cylinder block 12 is disposed so as to abut against a thrust bearing 48.

A portion of the rotary shaft 36 between the rotor 44 and the cylinder block 12 penetrates through a cylindrical swash-plate boss 50 which is coupled to the rotor 44 by a hinge 52. The swash-plate boss 50 has a spherically concaved inner peripheral surface disposed in sliding contact with a spherical outer peripheral surface of a sleeve 54 which is axially movably fitted on the rotary shaft 36. Accordingly, the swash-plate boss 50 is tiltable relative to the rotary shaft 36 and is also rotatable together with the shaft 36. The swash-plate boss 50 has a counterweight 56 formed integrally therewith as a one-piece body, and a compression coil spring 58 is disposed between the sleeve 54 and the rotor 44.

An annular swash plate 60 is fitted around the swash-plate boss 50 and has an outer peripheral portion located inside recesses formed in the tails of the individual pistons 32. The recess of each tail has a pair of spherical seats set apart from each other in the axial direction of the corresponding piston 32, and a pair of semispherical shoes 62 are received in the respective spherical seats so as to slidably hold the outer peripheral portion of the swash plate 60 from opposite sides in the thickness direction of the swash plate 60.

Figure 2:
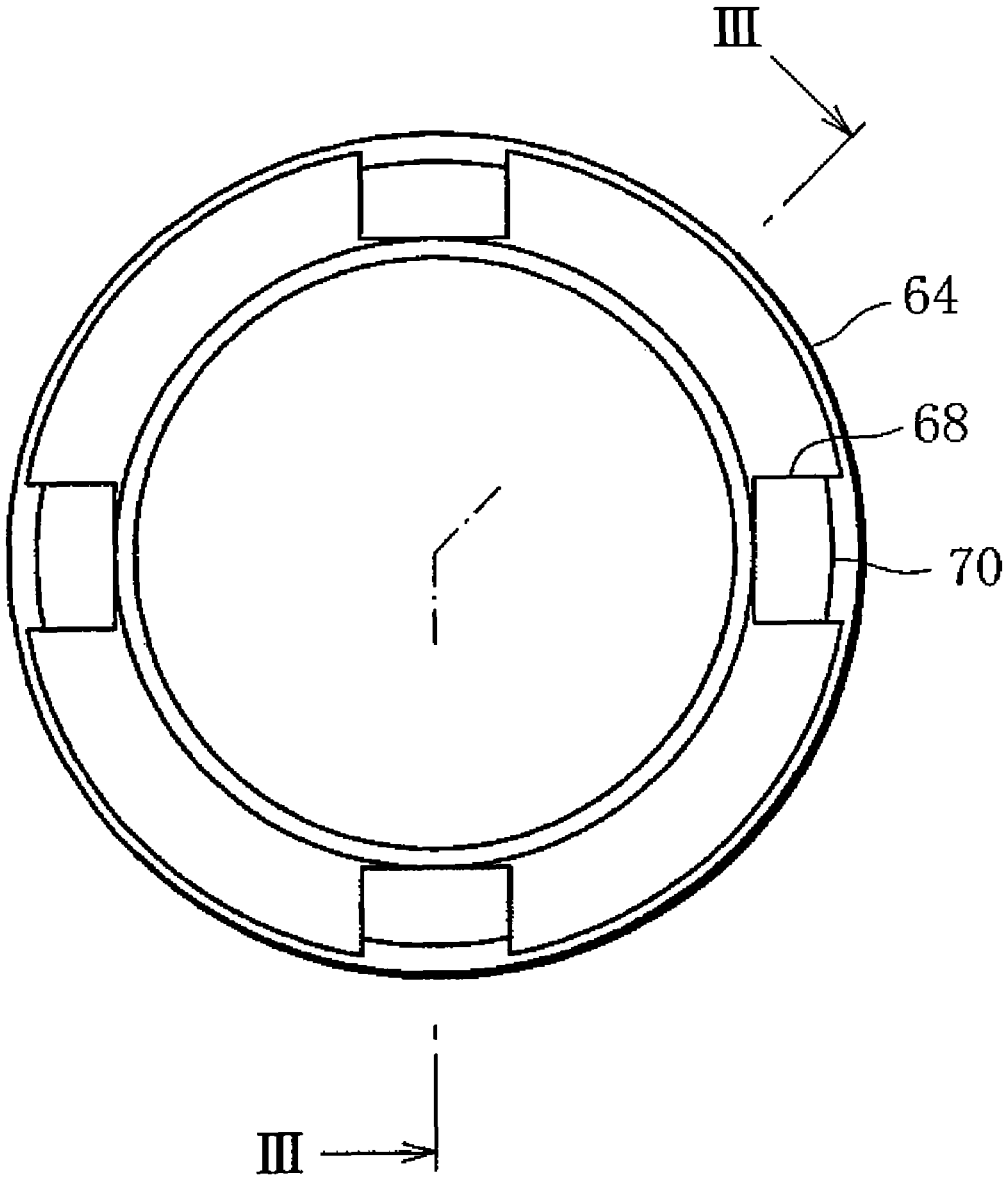
FIG. 2 is a plan view of a nut with engaging protuberances used in the compressor of FIG. 1.
Figure 3:
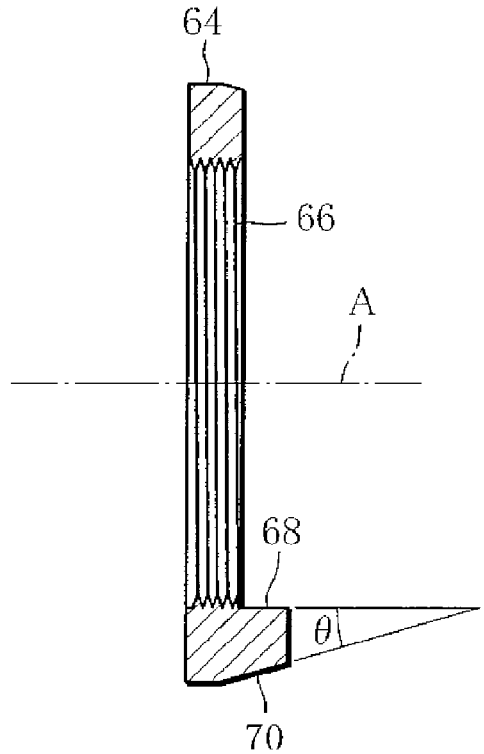
FIG. 3 is a sectional view taken along line in FIG. 2.

To allow the swash plate 60 to rotate together with the swash-plate boss 50, the swash plate 60 is fixed to the swash-plate boss 50 by a nut 64. More specifically, as shown in FIGS. 2 and 3, the nut 64 is annular in shape and has a thread groove 66 cut in an inner peripheral surface thereof.

The nut 64 has engaging protuberances 68 protruding in the axial direction thereof. Preferably, the engaging protuberances 68 protrude from that end face of the nut 64 which is located opposite the swash plate 60 to be fixed. The engaging protuberances 68 can be engaged with a tool for screwing the nut 64 on the swash-plate boss 50.

The engaging protuberances 68 are four in number, for example, and are arranged at intervals of 90 degrees in the circumferential direction of the nut 64. The shape of the nut 64, inclusive of the engaging protuberances 68, is determined so that a sufficient clearance may be left between the nut 64, that is, the engaging protuberances 68, and the pistons 32 moving nearby.

Preferably, the outer surface of each engaging protuberance 68 as viewed in the radial direction of the nut 64 is formed as a tapered surface 70. The tapered surface 70 is inclined so as to approach the axis A of the nut 64 with distance from the end face of the nut 64 in the axial direction. The angle θ of inclination of the tapered surface 70 is within the range from 10° to 20° and is nearly equal to the inclination angle formed between the rotary shaft 36 and the axis of the swash-plate boss 50 when the swash-plate boss 50 is tilted at a maximum angle relative to the rotary shaft 36.

Figure 4:
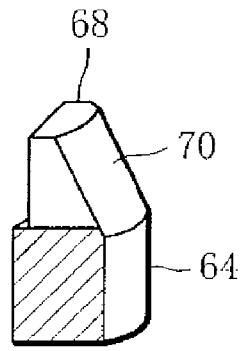
FIG. 4 is a perspective view showing part of the nut of FIG. 2 together with the engaging protuberance.

The tapered surface 70 is a curved surface similar to one obtained by cutting out part of the lateral surface of a circular truncated cone, as shown in FIG. 4 in which the curvature is somewhat exaggerated.

Figure 5:
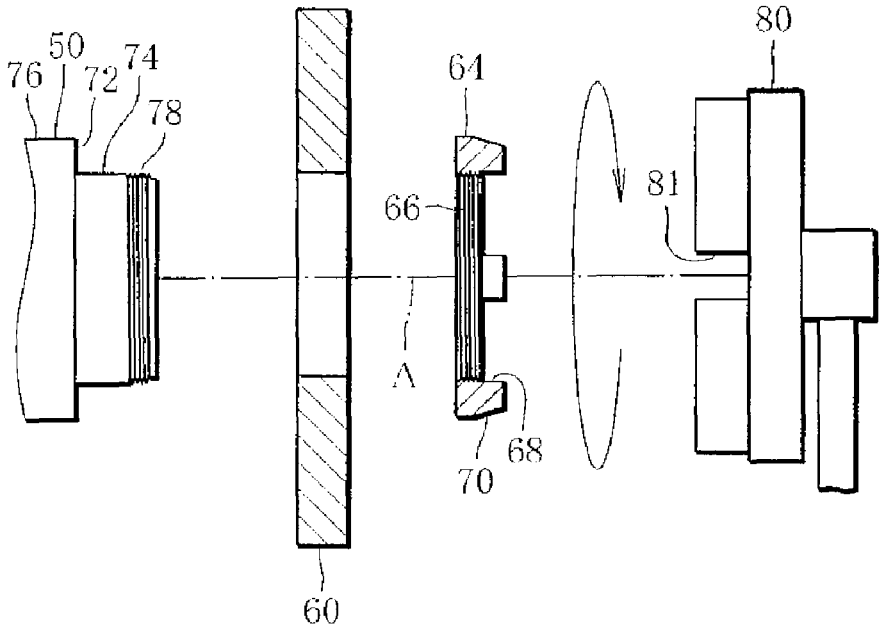
FIG. 5 is an exploded view illustrating a method of fixing a swash plate to a swash-plate boss of the compressor shown in FIG. 1, by using the nut of FIG. 2.
Figure 6:
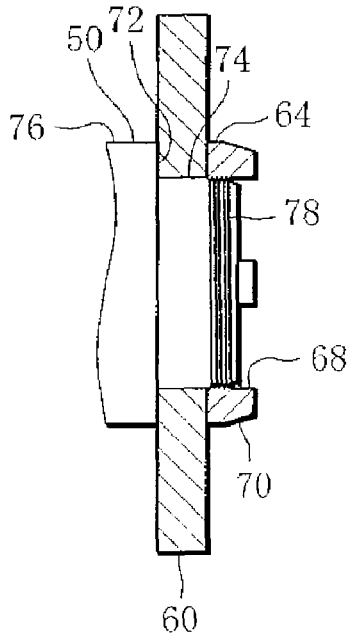
FIG. 6 shows the swash-plate boss, the swash plate and the nut assembled by the method illustrated in FIG. 5.

FIG. 5 schematically illustrates a method of fixing the swash plate 60 by the nut 64. The swash-plate boss 50 has a small-diameter section 74 and a large-diameter section 76, which are demarcated by a shoulder 72. A thread groove 78 is cut in the outer peripheral surface of a distal end portion of the small-diameter section 74, and the distal end portion of the small-diameter section 74 constitutes a male screw. When the swash plate 60 is fitted around the small-diameter section 74 and brought into contact with the shoulder 72, the distal end portion of the small-diameter section 74 projects from the swash plate 60. The nut 64 is screwed onto the distal end portion of the small-diameter section 74 projecting from the swash plate 60, so that the swash plate 60 is tightly held between the nut 64 and the shoulder 72 and thus is fixed to the swash-plate boss 50, as shown in FIG. 6.

Figure 7:
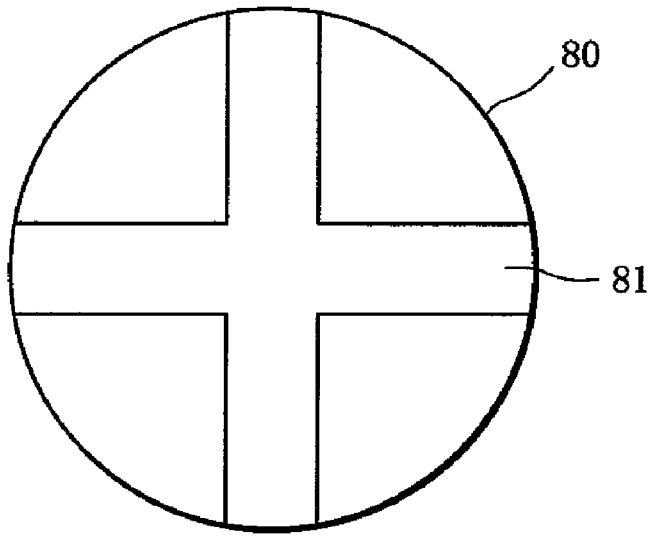
FIG. 7 is a plan view of a tool used in the method illustrated in FIG. 5.

In FIG. 5, reference numeral 80 denotes the tool for turning the nut 64. As shown in FIG. 7, the tool 80 has a crisscross groove 81, for example. With the engaging protuberances 68 received in the groove 81, the tool 80 is turned, whereby the nut 64 is easily screwed on the swash-plate boss.

Operation of the compressor constructed as above will be now described.

When the electromagnetic clutch 34 is turned on, motive power is transmitted through the electromagnetic clutch 34 to the rotary shaft 36, so that the rotary shaft 36 rotates. The rotating motion of the rotary shaft 36 is converted to reciprocating motion of the pistons 32 by the aforementioned conversion mechanism, namely, through the agency of the rotor 44, the hinge 52, the swash-plate boss 50, the swash plate 60, and the shoes 62. As each piston 32 reciprocates, a series of processes takes place within the compressor, the processes including a suction stroke in which a refrigerant in the suction chamber 22 is drawn into the cylinder bore 26 through the suction reed valve, a compression stroke in which the refrigerant is compressed inside the cylinder bore 26, and a discharge stroke in which the compressed refrigerant is discharged to the discharge chamber 24 through the discharge reed valve.

The amount of the refrigerant discharged from the compressor varies as the pressure (back pressure) in the crank chamber 20 rises or lowers in accordance with the ON/OFF state of the solenoid valve. Specifically, the swash plate 60 is tilted so that equilibrium may be reached among the compressive reaction force acting on the pistons 32, the back pressure, and the urging force exerted on the swash plate 60 by the compression coil spring 58, with the result that the stroke length of the individual pistons 32 increases or decreases.

In the compressor described above, the engaging protuberances 68 for engagement with the tool 80 protrude in the axial direction of the nut 64. Accordingly, the nut 64 has increased mechanical strength, and also a sufficient clearance is secured between the nut 64, or the engaging protuberances 68, and the pistons 32. The compressor can therefore provide high reliability even if reduced in size.

The engaging protuberances 68 constituting part of the nut 64 can be easily formed at the same time that the nut 64 is formed using a former or the like. Consequently, the nut 64 can be manufactured at high productivity, making it possible to provide the compressor at low cost.

Also, the engaging protuberances 68 protrude from that end face of the nut 64 which is located opposite the swash plate 60, and accordingly, it is easy to engage the tool 80 with the engaging protuberances 68, whereby the nut 64 can be easily screwed onto the swash-plate boss.

Further, in the aforementioned compressor, the inclination angle θ of the tapered surface 70 of each engaging protuberance 68 is nearly equal to the inclination angle formed between the rotary shaft 36 and the axis of the swash-plate boss 50 when the swash-plate boss 50 is tilted at the maximum angle relative to the rotary shaft 36, that is, when the displacement of the compressor is at a maximum. Accordingly, a sufficient clearance is always secured between the engaging protuberances 68 and the pistons 32 even when the swash-plate boss 50 is tilted.

Figure 8:
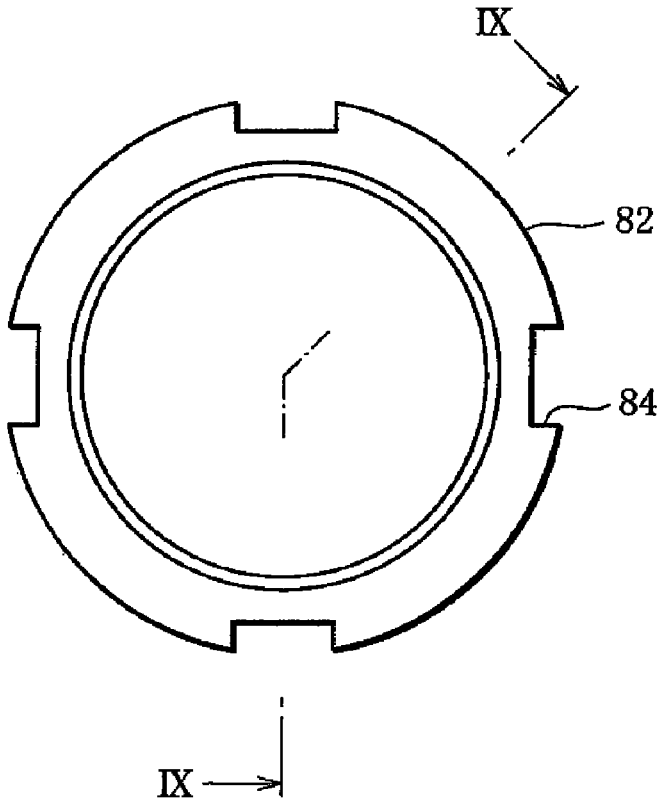
FIG. 8 is a plan view of a nut as Comparative Example 1.
Figure 9:
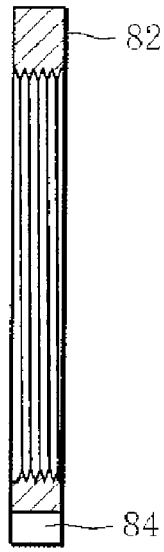
FIG. 9 is a sectional view taken along line IX-IX in FIG. 8.

FIGS. 8 and 9 illustrate a nut 82 as Comparative Example 1. The nut 82 has cuts 84 formed therein for engagement with a nut tightening tool. In the case of the nut 82, the cuts 84 lead to a reduction in the cross-sectional area, so that the mechanical strength of the nut 82 decreases.

Figure 10:
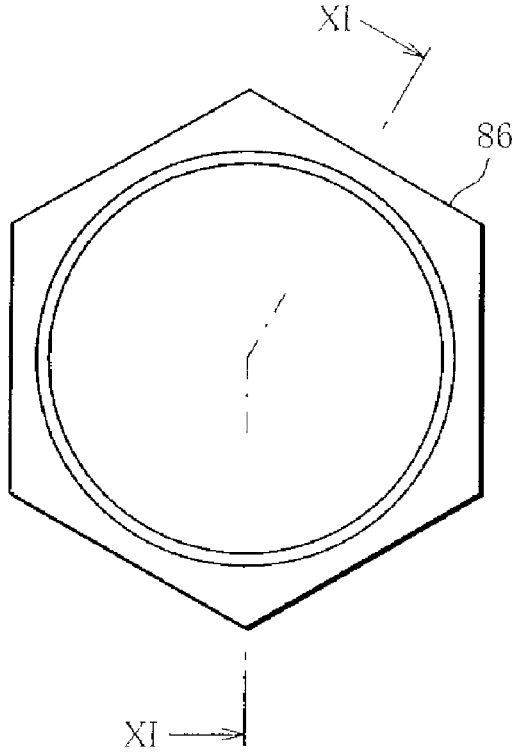
FIG. 10 is a plan view of a nut as Comparative Example 2.
Figure 11:
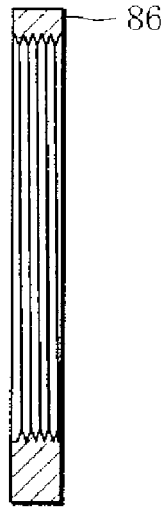
FIG. 11 is a sectional view taken along line XI-XI in FIG. 10.

FIGS. 10 and 11 illustrate a nut 86 as Comparative Example 2, which has a hexagonal shape for engagement with a nut tightening tool. In this case, the nut 86 has a smaller thickness at the center of each side of the hexagonal form, and the small-thickness portions have deficient mechanical strength.

Figure 12:
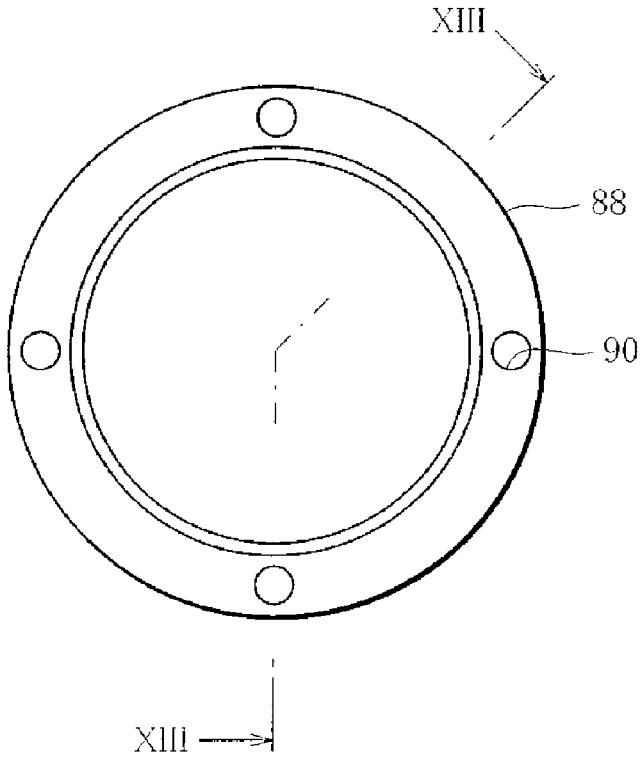
FIG. 12 is a plan view of a nut as Comparative Example 3.
Figure 13:
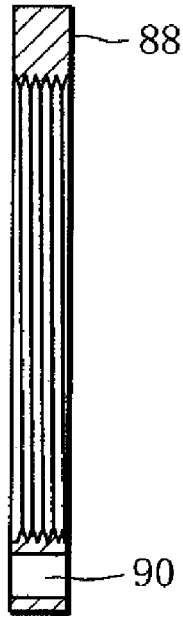
FIG. 13 is a sectional view taken along line XIII-XIII in FIG. 12.

FIGS. 12 and 13 illustrate a nut 88 as Comparative Example 3, through which are formed engagement holes 90 for engagement with a nut tightening tool. In this case, the nut 88 has a smaller cross-sectional area at portions corresponding to the engagement holes 90, and therefore, has deficient mechanical strength.

The present invention is not limited to the first embodiment described above and may be modified in various ways.

Figure 14:
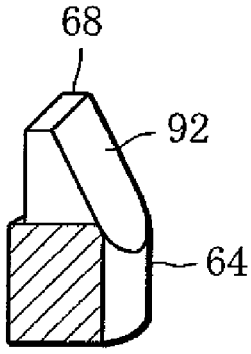
FIG. 14 is a perspective view showing a modification of the engaging protuberance of FIG. 4, which has a flat outer surface.

For example, in the first embodiment, each engaging protuberance 68 has the tapered outer surface 70 with a given curvature. Alternatively, the outer surface of each engaging protuberance 68 may be an inclined flat surface 92, as shown in FIG. 14. Like the tapered surface 70, the flat surface 92 preferably has an inclination angle nearly equal to that formed between the rotary shaft 36 and the axis of the swash-plate boss 50 when the displacement of the compressor is at a maximum. The flat surface 92 can be easily formed by chamfering.

Figure 15:
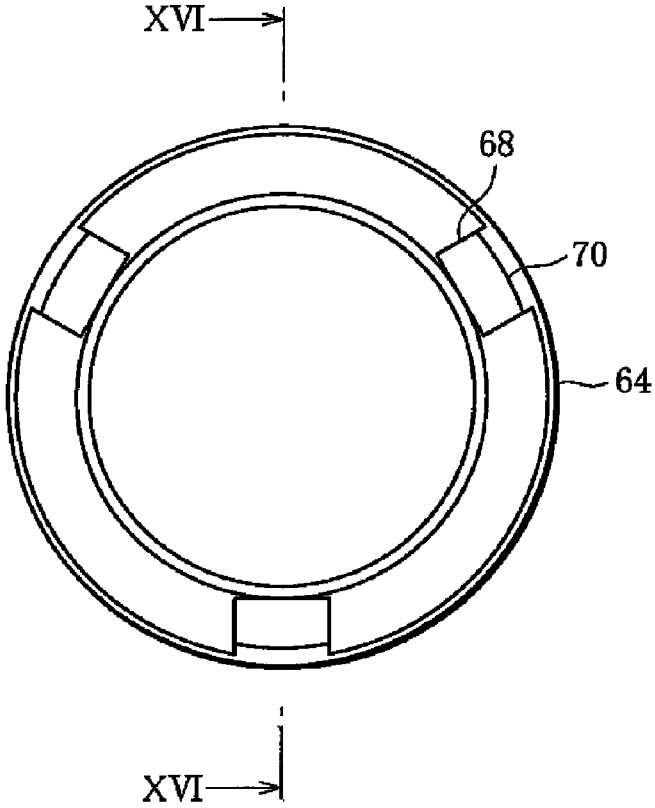
FIG. 15 is a plan view of a nut with engaging protuberances according to a modification of the first embodiment.
Figure 16:
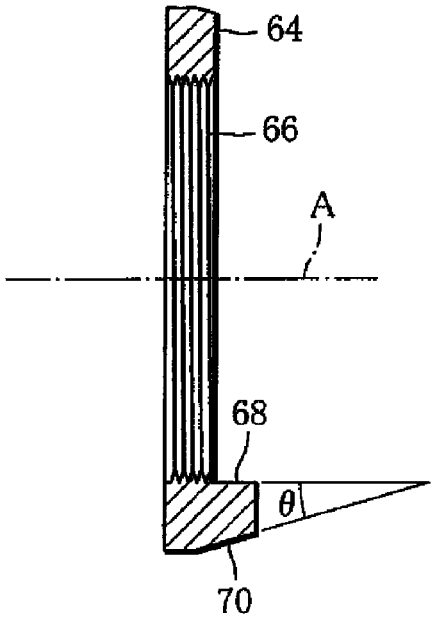
FIG. 16 is a sectional view taken along line XVI-XVI in FIG. 15.

Also, in the first embodiment, the nut 64 is provided with four engaging protuberances 68. The number of the engaging protuberances 68 is not particularly limited insofar as the engaging protuberances 68 can be engaged with a nut tightening tool, and may be three, as shown in FIGS. 15 and 16.

Further, in the first embodiment, the engaging protuberances 68 each have the tapered outer surface 70 but may have any desired profile insofar as a sufficient clearance is left between the engaging protuberance 68 and the pistons 32 moving nearby.

In the first embodiment, moreover, part of the outer peripheral surface of the nut 64 is also tapered in a continuous manner at the same inclination angle θ as the tapered surface 70. In the case of forming an inclined surface, such as the tapered surface 70 or the flat surface 92, as the outer surface of each engaging protuberance 68, at least part of the outer surface of the engaging protuberance 68, including the distal end, may be formed as such inclined surface.

Figure 17:
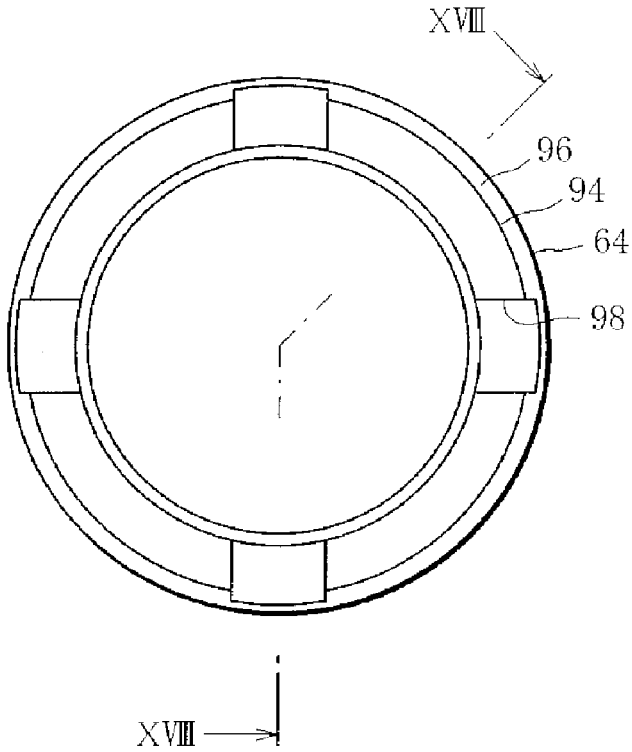
FIG. 17 is a plan view of a nut with engaging protuberances according to a second embodiment.
Figure 18:
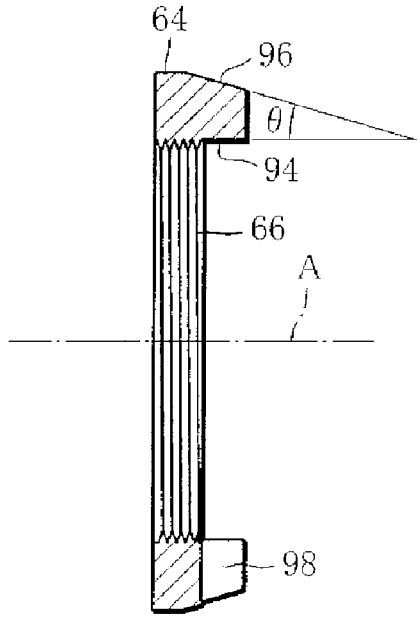
FIG. 18 is a sectional view taken along line XVIII-XVIII in FIG. 17.

FIGS. 17 and 18 illustrate a nut 64 with four engaging protuberances 94 according to a second embodiment. Each of the four engaging protuberances 94 arcuately extends in the circumferential direction of the nut 64, when taken in plan view. Each engaging protuberance 94 has a tapered outer surface 96, and the inclination angle θ of the tapered surface 96 is preferably set in the same manner as the inclination angle θ of the tapered surface 70. The engaging protuberances 94 are spaced from each other in the circumferential direction of the nut 64, and a recess 98 located between adjacent ones of the engaging protuberances 94 serves as a means for engagement with a nut tightening tool. The number and arrangement of the recesses 98 are not particularly limited.

Figure 19:
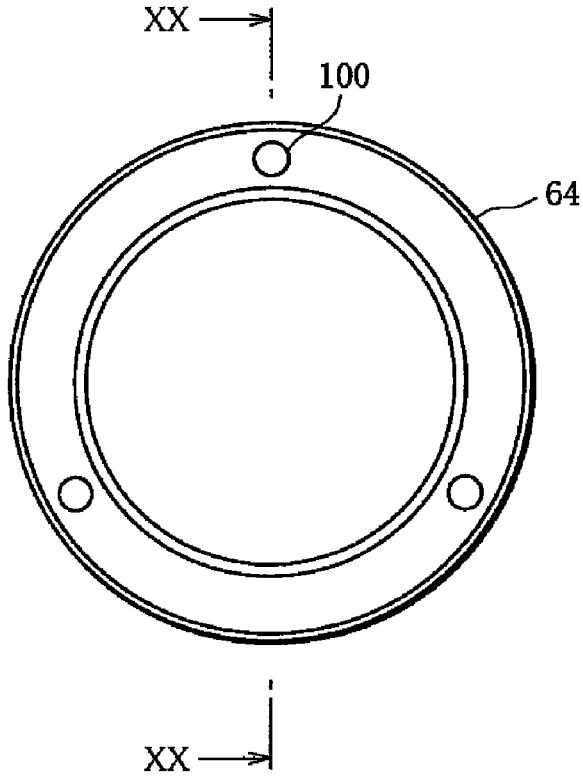
FIG. 19 is a plan view of a nut with engaging protuberances according to a third embodiment.
Figure 20:
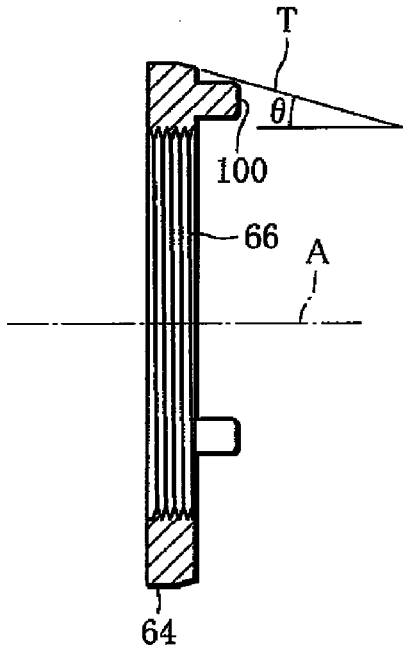
FIG. 20 is a sectional view taken along line XX-XX in FIG. 19.

FIGS. 19 and 20 illustrate a nut 64 with three columnar engaging protuberances 100 according to a third embodiment. The engaging protuberances 100 are located closer to the axis A of the nut 64 than an imaginary tapered surface T which is so defined as to avoid contact with the pistons 32. Thus, a sufficient clearance is always secured between the engaging protuberances 100 and the pistons 32 even when the swash-plate boss 50 is tilted. The inclination angle θ of the imaginary tapered surface T also is preferably set in the same manner as the inclination angle θ of the tapered surface 70. The number and arrangement of the engaging protuberances 100 are not particularly limited.

The variable displacement swash plate compressor of the present invention can of course be used to compress refrigerants other than $CO_2$.

The invention claimed is:

1. A variable displacement swash plate compressor comprising:

a swash-plate boss permitting a rotary shaft to extend therethrough and coupled to the rotary shaft such that the swash-plate boss is tiltable relative to the rotary shaft, the swash-plate boss having a thread groove cut in an outer peripheral surface thereof;

an annular swash plate fitted around the swash-plate boss;

a nut screwed on the thread groove of the swash-plate boss to fix the swash plate to the swash-plate boss;

a conversion device for converting rotational motion of the swash plate to reciprocating motion of pistons; and engaging protuberances formed integrally with the nut and protruding in a direction parallel with an axis of the nut to be engaged with a tool for turning the nut, the engaging protuberances being arranged at regular intervals in a circumferential direction of the nut.

2. The variable displacement swash plate compressor according to claim 1, wherein the engaging protuberances protrude from an end face of the nut located opposite the swash plate.

3. The variable displacement swash plate compressor according to claim 2, wherein: out of an outer peripheral surface of the nut and outer surfaces of the engaging protuberances as viewed in a radial direction of the nut, at least part of the outer surface of each of the engaging protuberances has at least one of a tapered region and a flat region as an inclined surface which is inclined so as to approach the axis of the nut at a distance from the nut, and the inclined surface has an inclination angle substantially equal to that formed between a rotary shaft and an axis of the swash-plate boss when the swash-plate boss is tilted at a maximum angle relative to the rotary shaft.

4. The variable displacement swash plate compressor according to claim 2, wherein: the engaging protuberances are located inward of an imaginary tapered surface which is defined so as to avoid contact of the engaging protuberances with pistons, and the imaginary tapered surface has an inclination angle nearly equal to that formed between a rotary shaft and an axis of the swash-plate boss when the swash-plate boss is tilted at a maximum angle relative to the rotary shaft.

* * * * *